US005195341A

United States Patent [19]

Nieuwkoop

[11] Patent Number: 5,195,341

[45] Date of Patent: Mar. 23, 1993

[54] ELECTRONIC CYLINDER LOCK WITH INDUCTIVELY COUPLED KEY

[75] Inventor: Evert Nieuwkoop, Pijnacker, Netherlands

[73] Assignee: Chubb Lips Nederland bv, Dordrecht, Netherlands

[21] Appl. No.: 811,097

[22] Filed: Dec. 20, 1991

[30] Foreign Application Priority Data

Jan. 8, 1991 [GB] United Kingdom ..... 9100336

[51] Int. Cl.[5] ..... E05B 47/00

[52] U.S. Cl. ..... 70/278; 70/413

[58] Field of Search ..... 70/277-283, 70/413

[56] References Cited

U.S. PATENT DOCUMENTS

| | | | |
|---|---|---|---|
| 3,842,629 | 10/1974 | Pazer et al. | 70/276 X |
| 4,232,353 | 11/1980 | Mosciatti et al. | 70/277 X |
| 4,458,512 | 10/1984 | Gelhard | 70/277 |
| 4,549,176 | 10/1985 | Kreft | 340/825.31 |
| 4,602,253 | 7/1986 | Kreft | 340/825.31 |
| 4,918,955 | 4/1990 | Kimura et al. | 70/413 X |
| 5,005,393 | 4/1991 | Ewalds et al. | 70/277 |

FOREIGN PATENT DOCUMENTS

| | | | |
|---|---|---|---|
| 0144481 | 6/1990 | Japan | 70/276 |
| WO88/03594 | 5/1988 | PCT Int'l Appl. . | |
| 2158870A | 11/1985 | United Kingdom . | |
| 2174452A | 11/1986 | United Kingdom . | |

*Primary Examiner*—Lloyd A. Gall
*Attorney, Agent, or Firm*—Anna E. Mack

[57] ABSTRACT

An electronic lock is constructed to resemble the appearance and functionality of a conventional cylinder lock. Its key has a bit in which is mounted an integrated circuit chip storing the key code and including a transmission coil for inductive coupling with a reading head in the lock. The latter includes a coil for generating a high frequency alternating magnetic field across a localized region of the keyway concentrated via a toroidal ferrite core structure which defines a gap spanning the keyway through which the chip passes when the key bit is inserted. This core structure includes a U-shaped part in the stationary lock housing around which the coil is wound, and two parts mounted in the barrel, one to either side of the keyway, which register with the part in the housing when the barrel is in the key-reading position. Further ferrite pads may be mounted to either side of the coil in the key itself, to register with the ferrite parts in the barrel. By virtue of this core structure, optimum flux coupling between the lock and key may be achieved, thereby minimizing power consumption.

19 Claims, 4 Drawing Sheets

ELECTRONIC CYLINDER LOCK WITH INDUCTIVELY COUPLED KEY

BACKGROUND

The present invention relates to locks and more particularly to "electronic" key locks of the kind where a code is received by the lock from a proper key by way of key locks are relatively well known, at least in the patents literature, as exemplified by DE-2634303, EP-0115747, GB-2158870, GB-2174452, US-4549176, US-4602253 and WO-88/03594. The principle of operation of such devices is that the lock generates an alternating magnetic field in a region into which the key is brought, the key having circuit elements which control an inductive transmission element on the key to modulate or add to the field generated by the lock in such a way as to enable detection by the lock of a code programmed into the key. Preferably, although not essentially, the power for the circuit elements of the key is derived by rectification of the voltage induced by the alternating field of the lock. A particular advantage of this form of code transmission is that it avoids the need for any galvanic contact between the lock and key.

It is recognised that, both in the interests of user acceptance and to maximise the utilisation of standard lock components and furniture, it is desirable that the overall appearance, dimensions and functionality of "electronic" key locks should resemble as far as practicable those of their conventional mechanical counterparts. The present invention is therefore concerned with an "electronic" lock which can resemble a conventional mechanical cylinder lock in that it comprises a housing bearing a rotatable barrel with a keyway, into which the key is inserted and turned in order to retract the associated bolt or other such locking member. A lock of this style operating on the inductive coupling principle, more particularly for vehicle doors, is disclosed in GB-2174452. In this prior art arrangement, the induction elements of both lock and key comprise a respective coil with a soft iron core. The lock coil is mounted longitudinally in a bushing at the end of the barrel, to one side of the keyway, while the key coil is mounted longitudinally in its tip, so that when the key is fully inserted in the barrel the two coils lie side-by-side, with their cores in parallel. It is evident that in an arrangement such as that, however, only a partial inductive coupling between the two coils can be achieved, in the sense that much of the magnetic flux generated by either coil will follow a path which does not pass through the other. In consequence, the total magnetic flux and energising power requirements of the lock are higher than they need be if a more efficient coupling of the inductive elements were achieved. Furthermore, mounting the lock coil in the rotating barrel causes complications for its electrical connection to the rest of the field-generating and processing circuitry. In GB-2174452 this coil is connected by conductors which will be twisted whenever the barrel is turned, and for which there would be an eventual risk of breakage particularly if the barrel was required to describe a large turning angle.

It is particularly desirable in the operation of a lock of this character that its power consumption be minimised, for example so that a usefully long service life can be expected when battery-operated, and because more costly components are required when high power levels must be handled. In addition, current EMC (electromaqnetic compatibility) standards effectively restrict the permissible radiated electromaqnetic power of devices such as electronic locks. Because this radiated power is directly related to the power levels handled in the lock, it is advantageous to keep these levels to a minimum. We believe that these criteria can best be met in an inductively-coupled lock by ensuring that the respective inductive elements are positioned such as to maximise the linkage of magnetic flux between them when reading the code from the key. Accordingly, it is an aim of the invention to provide an inductively-coupled lock of "cylinder" style in which this linkage is maximised, and in particular is improved over the arrangement in GB-2174452.

SUMMARY OF THE INVENTION

In a first aspect the invention therefore resides in a lock comprising: a housing; a barrel defining a keyway borne rotatably in the housing and adapted to receive and be turned by a proper coded key; reading means adapted to receive the code from a proper key when inserted in said keyway, by way of inductive coupling with a code transmission element of the key; and means for controlling the operation of the lock whereby to enable the retraction of a bolt or other such locking member by turning of the barrel when a proper key code is received via said reading means; wherein the reading means includes a coil for generating an alternating magnetic field in a region of said keyway and a coil (preferably the same as the first-mentioned coil) for detecting a modulation or addition to said field by the transmission element of a proper key when located in said region of the keyway; said coil(s) surrounding part of a toroidal (i.e. ring-like) magnetically-permeable core structure which defines a gap spanning the aforesaid region of said keyway; and wherein said core structure is collectively defined at least by a first frusto-toroidal part mounted in said housing, around which said coil(s) wind, and which presents two ends in proximity to said barrel, and by two further parts mounted in the barrel, one to either side of the aforesaid region of said keyway, and which are juxtaposed to respective ends of said first part when the barrel is in the key-reading position relative to the housing.

In this way, the magnetic flux generated/received by the coil(s) in the lock housing is concentrated in the toroidal structure collectively defined by the aforesaid magnetically-permeable (preferably ferrite) parts in the housing and barrel, and can pass across the region of the keyway wherein the transmission element of the key is located with only minor losses. This maximisation of the flux coupling between lock and key thereby provides a solution to the power consumption and EMC requirements discussed above. It also means that relatively small and simple coils can be used in the lock housing and in the transmission element of the key, thereby minimising their cost and facilitating the implementation of an on-chip key coil as proposed in WO-88/03594 if desired. Furthermore, minimising the required size of the key coil minimises any problems of weakening the key by incorporating that element and minimises the chip cost (in the case of an on-chip coil) because the latter is directly related to the amount of chip area. In addition, by mounting the coil(s) of the reading means in the (fixed) housing there are no problems associated with electrical connections to a rotating part and no consequent constraints on the turning angle of the barrel.

The invention also resides in the combination of a lock according to the above-defined first aspect of the invention with a key having a bit for insertion into the aforesaid keyway and which bears an inductive transmission element for modulating or adding to the aforesaid magnetic field, the transmission element being positioned in said bit so as to pass into the aforesaid region of the keyway when the bit is so inserted. In a preferred embodiment, the transmission element of the key is located between two further parts of said toroidal core structure which are mounted in the key bit and juxtaposed to respective said parts mounted in the barrel when the key is inserted in the keyway.

The invention will now be more particularly described, by way of example, with reference to the accompanying drawings.

DETAILED DESCRIPTION OF THE PREFERRED EMBODIMENT

Figure 1:
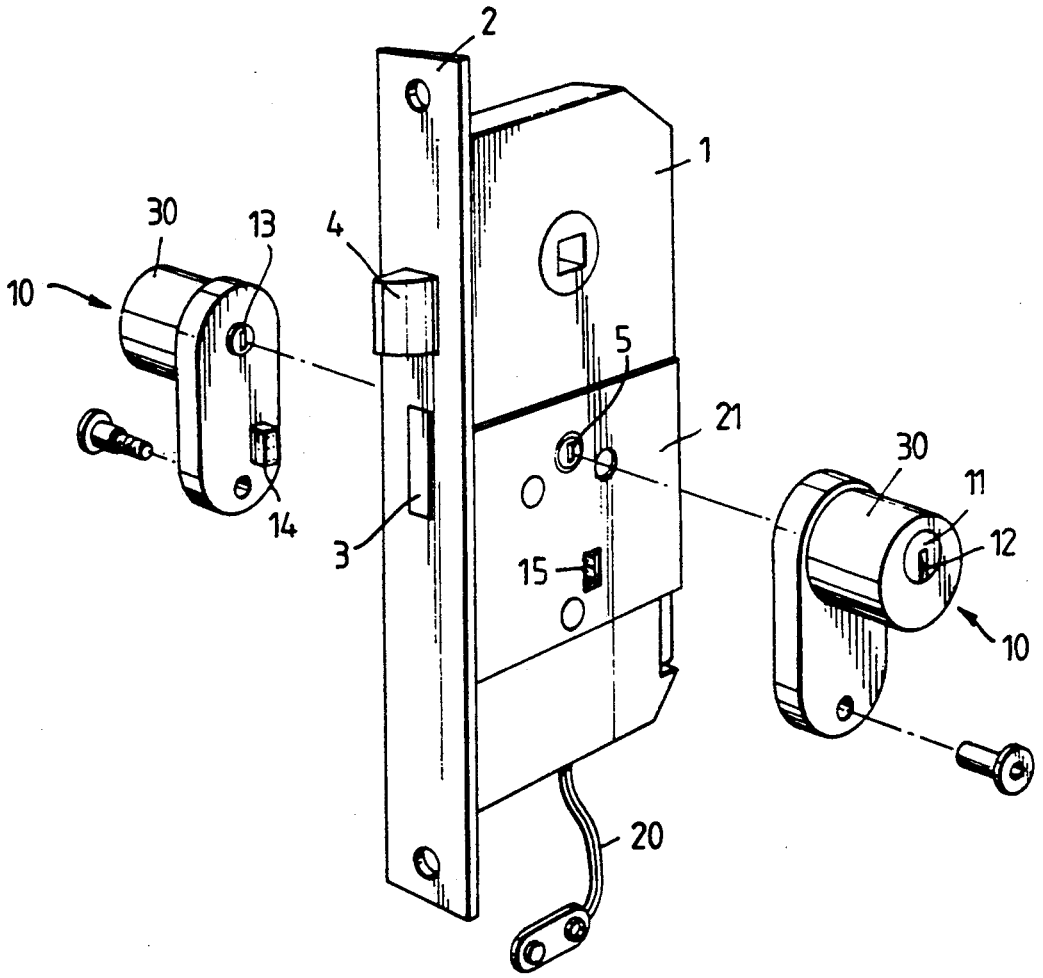
FIG. 1 shows one example of a lock to which the present invention may be applied.
Figure 2:
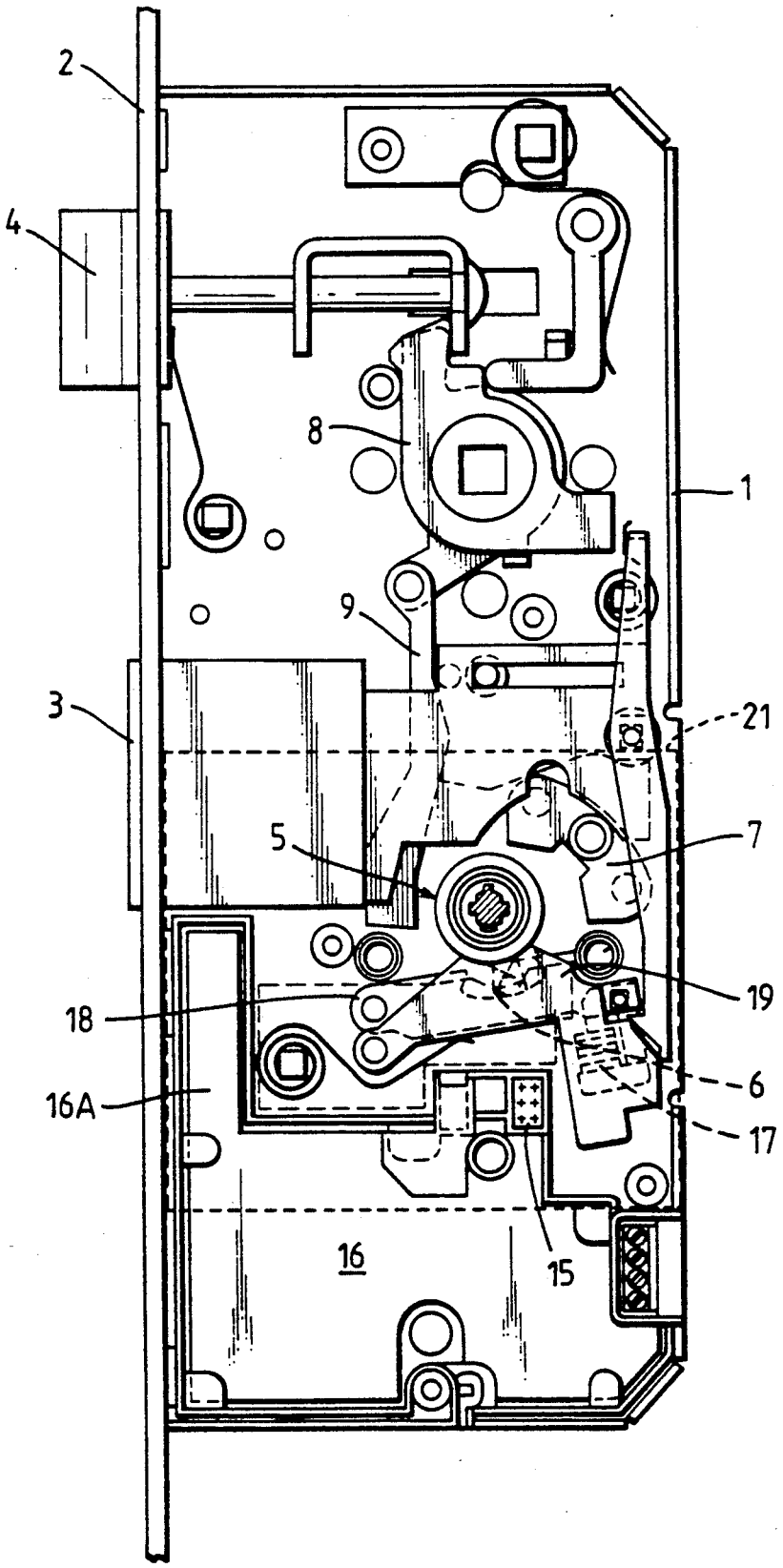
FIG. 2 is an interior view of the lock of FIG. 1.

With reference to FIGS. 1 and 2 the illustrated lock is of mortice style having a casing 1 and a forend 2 through which extend a dead bolt 3 and a latch bolt 4. Extension and retraction of the dead bolt 3 is in response to rotation in an appropriate sense of an internal thrower 5 having a radial lug 6 which drives the bolt through the agency of a runner 7 moving along an arcuate track, the geometry of the runner/bolt relationship being such as to deadlock the bolt against end pressure when thrown. Retraction of the latch bolt 4 is in response to the turning of a cam 8 by means of external handles (not shown) and is likewise accomplished, via a linkage 9, by rotation of the thrower 5 to withdraw the dead bolt. As thus far described, the mechanism is of conventional design much practised by the present applicants.

Mounted externally to respective sides of the lock case 1 are pair of cylinder units 10. Each such unit has a rotatable barrel 11 with a keyway 12 and, at its inner end, a drive socket 13 whereby to turn the thrower 5. Associated with the keyway in each cylinder unit 10 is a reading head for transducing a code signal from a proper key when inserted therein by way of an inductively-coupled transponder method, e.g. as described in WO-88/03594 and the preferred structure of which is more fully described below. In any event, when a proper coded key is inserted into either keyway 12 its code signal is detected by the respective reading head and transmitted via a plug connector 14 in the rear of the respective cylinder unit and a respective socket 15 in the lock case to a PCB 16 inside the lock which mounts the processing electronics which serve to determine if the key code is valid, and if so the coil of an electromagnet 17 is energised. This electromagnet is the operative part of an electro-mechanical release mechanism full details of the construction and operation of which are to be found in our copending European patent application no. 0392596. Suffice to say for the purposes of the present application, while the electromagnet 17 remains de-energised the thrower 5 is blocked by a lever 18 from turning far enough to shift the bolt(s), but when the electromagnet is energised such turning of the thrower is enabled as the lever 18 is cammed away together with another lever 19 upon which the electromagnet is mounted.

Electrical energy for the processor, reading heads and release mechanism is supplied via a lead 20 from a battery pack (not shown) housed in another mortice in the door.

Additional physical protection for the bolt runner 7, release mechanism 17/18/19 and at least that part 16A of the PCB 16 which mounts an interface circuit between the processor and the electromagnet 17 is provided by hardened steel anti-drill plates 21 located to each side of the lock case 1. The interface circuit on PCB part 16A is directly connected with the electromagnet 17 by a cable (not shown) situated between these anti-drill plates.

Figure 3:
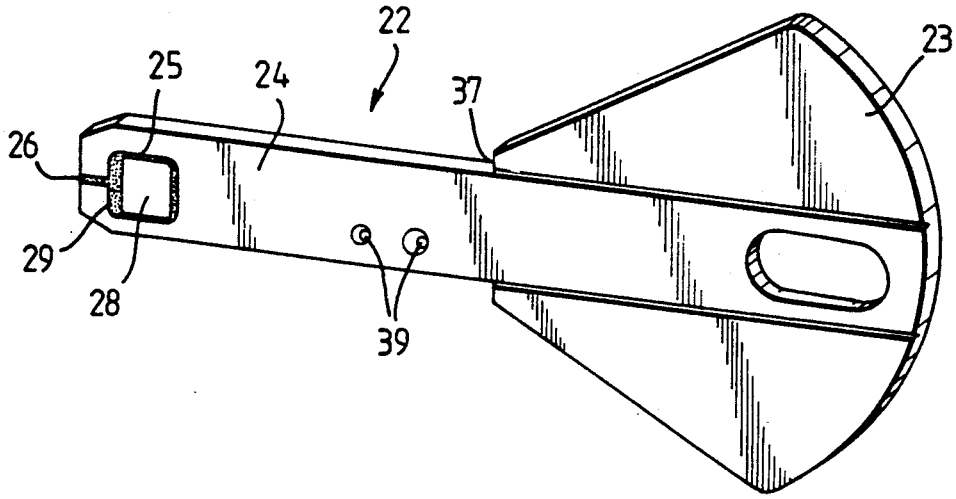
FIG. 3 is a view of a key for use with the lock of FIGS. 1 and 2.

A key 22 of the proper form for use with this lock is shown in FIG. 3. It comprises a preferably metal blank of e.g. nickel-silver, brass or aluminium, defining bow 23 and bit 24 portions, with a transverse aperture 25 through the bit near to its tip and a narrow transverse gap 26 extending from that aperture to the tip. Mounted within the aperture 25 is an integrated circuit chip 27 (see FIG. 5) which defines the whole of the key electronics and which is sandwiched between two pads of ferrite 28. The assembly of chip 27 and ferrite pads 28 is secured by an epoxy resin or other inert filler 29 which fills also the gap 26. The material 29 preferably surrounds all four edges of the chip/ferrite assembly 27/28 between the metal blank to cushion that assembly from the effect of mechanical shocks e.g. if the key is dropped onto a hard floor. The chip 27 includes inter alia a memory programmed with an identification or authorisation code which when transferred to the processor of the lock enables release of the thrower 5 for turning by the respective barrel 11 as indicated above. The key may also include one or more drillings 39 for cooperation with conventional pin tumblers (not shown) acting between the barrels 11 and housings 30 for indexing the key insertion and withdrawing position, preventing the barrel from being turned unless the key is fully inserted (and preventing the key from being removed until the barrel has been fully turned), and possibly providing mechanical differs between different locks and their keys. However, the principal and essential code-bearing element of the key is the IC chip 27.

Figure 4:
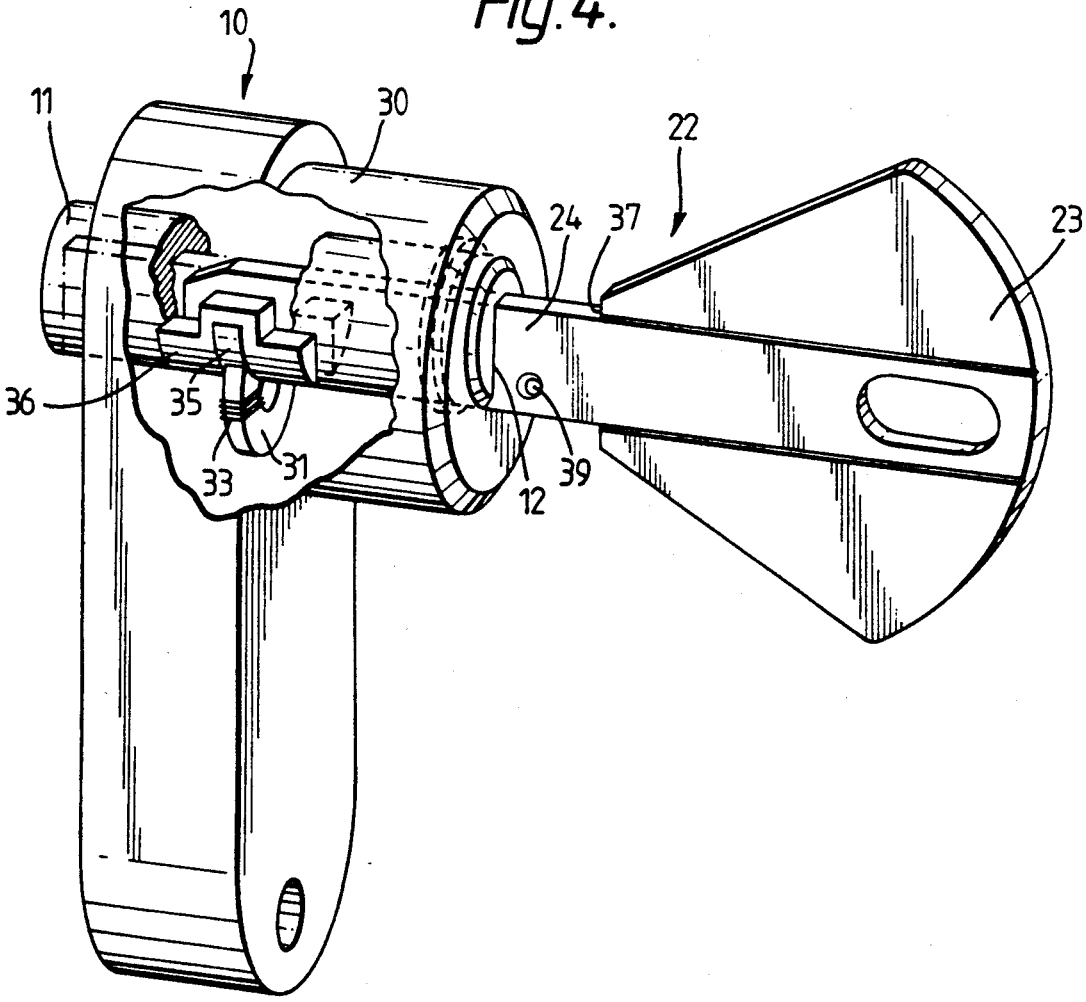
FIG. 4 is a view partially broken away showing the key in the course of insertion into a cylinder unit of the lock.
Figure 5:
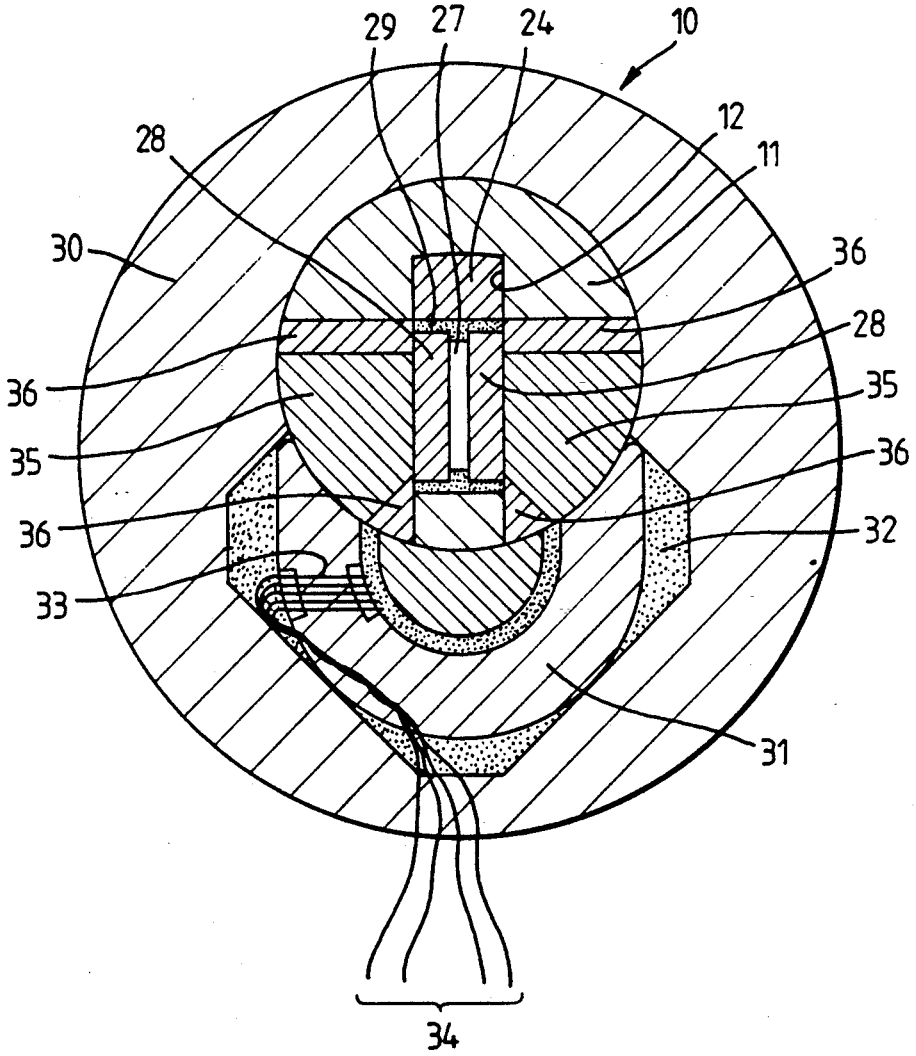
FIG. 5 is a transverse cross-section through the key and cylinder unit in the position of FIG. 4.

With reference to FIGS. 4 and 5, these show the structure of the inductive reading head in each cylinder unit 10. These units comprise a housing 30 of die-cast alloy, e.g. Mazak, or possibly of plastics, in which is journalled the respective barrel 11 of e.g. brass or again possibly plastics. Mounted within the housing at a selected axial distance from its front face is a U-shaped ferrite element 31. This is embedded in the housing 30 in epoxy resin or other inert filler 32 and has its two ends juxtaposed to the barrel 11. Wound around one of the limbs of this U, close to the barrel, is a field-generating and detection coil 33, connected by wires 34 to an associated oscillator and detection circuit (not shown). The barrel 11 also incorporates two ferrite elements 35 at the same axial position as the housing element 31. The elements 35 extend from either side of the keyway 12 to the periphery of the barrel so as to be juxtaposed to respective ends of the element 31 when the barrel is in the key-insertion position shown in the Figures. In the case of a metal barrel 11, the ferrite elements 35 are electrically isolated therefrom by respective plastics inserts 36 (and which prevent the gap 26 in the key tip from being short-circuited by the metal barrel when the gap 26 just passes the ferrites 35 during insertion of the key).

In use, as the tip of a key 22 is passed into the entrance of the keyway 12 in either cylinder unit 10 a microswitch (not shown) in the respective housing 30 is depressed which actuates the aforesaid oscillator to supply a high frequency (typically 10 MHz) energising current to the coil 33, which induces a corresponding alternating magnetic field in the ferrite element 31. It will be appreciated especially from FIG. 5 that in the key-insertion position of the barrel 11 the juxtaposed ferrite elements 35 will act as extensions to the U-shaped element 31 and define collectively with that element a toroidal core structure with an air gap spanning a localised region of the keyway 12 between the ferrite elements 35 (FIG. 5) at a selected axial distance from its entrance which gap is closed upon insertion of the key. The magnetic flux generated by the coil 33 is concentrated in this core structure and passes across that region of the keyway with little loss. In this respect the relative magnetic permeability of the material in elements 31 and 35 is preferably at least 100 times that of free space, for a ferrite with low loss at the chosen frequency.

The axial distance of the ferrite core structure 31/35 along the keyway 12 is less than the axial distance along the key bit 24 of the chip 27 from the stop shoulder 37 which defines the limit of insertion of the key. Accordingly, the chip 27 and its flanking ferrite pads 28 pass through the alternating magnetic field between the ferrite elements 35 of the barrel before the key is fully inserted, and in the course of this passage the key code is read. More particularly, the key chip 27 may bear an integrated coil as its inductive transmission element, wound in a plane at right angles to the magnetic flux passing across the keyway and positioned for maximum coupling with the field generated by the housing coil 33. In the preferred embodiment a common coil structure may be used to perform the functions of both generating the field in the keyway and detecting the modulation or addition to the field caused by the insertion of a key. Alternatively, a separate coil may be used for each function. The coil on chip 27 is located symmetrically in the key, so the latter is reversible in the sense of its orientation for insertion in the keyway. The presence of the gap 26 in the key tip prevents the metal of the key blank surrounding the chip 27 from acting as a shorted turn around the key coil, which would otherwise introduce a high loss; (in the alternative a high-strength plastics blank could be used). The voltage induced in the key coil by the alternating magnetic field passing across the keyway is rectified to power the active components of the integrated circuit and its frequency, suitably divided, acts as a clock for logic circuitry which drives a shift register containing the identification code data from the aforesaid memory. This data is applied to the key coil so as to modulate or add to the field generated in the keyway by the housing coil 33 and the key code is derived in the lock by a detector circuit on the PCB 16 which is connected to the coil 33. Further details of the operation of the electronics to transfer the code from the key to the lock can be found in WO-88/03594. The key code is read in this way before the key is fully inserted in order to give the lock electronics time to determine the validity of the code and to give the electromagnet 17 of the release mechanism time to build up its attraction force to a maximum before the user of the key will begin turning of the barrel 11.

As will be appreciated from FIG. 5, the ferrite pads 28 on the key act as further extensions of the toroidal magnetic core structure 31/35 during insertion of the key, to further concentrate the alternating field in the region of the key coil. This material is hard and wear-resistant and also provides good physical protection to the IC chip 27. These ferrite pads on the key are not an essential feature of the invention, however, and in other embodiments one or both may be omitted, depending on the permissible width of the air gap in the overall toroidal core structure. Neither is the use of an on-chip key coil essential, and in other embodiments a discrete wire coil may be employed in the key in an equivalent location to the chip 27 illustrated in the Figures.

I claim:

1. A lock comprising: a housing; a barrel defining a keyway borne rotatably in the housing and adapted to receive and be turned by a proper coded key; reading means adapted to receive the code from a proper key when inserted in said keyway, by way of inductive coupling with a code transmission element of the key; and means for controlling the operation of the lock whereby to enable the retraction of a locking member by turning of the barrel when a proper key code is received via said reading means; wherein the reading means includes coil means for generating an alternating magnetic field in a region of said keyway and for detecting a modulation or addition to said field by the transmission element of a proper key when located in said region of the keyway; said coil(s) surrounding part of a toroidal magnetically-permeable core structure which defines a gap spanning the aforesaid region of said keyway; and wherein said core structure is collectively defined at least by a first frusto-toroidal part mounted in said housing, around which said coil means wind, and which presents two ends in proximity to said barrel, and by two further parts mounted in the barrel, one to either side of the aforesaid region of said keyway, and which are juxtaposed to respective ends of said first part when the barrel is a position relative to the housing in which the code can be received from a proper key.

2. A lock according to claim 1 wherein said coil means for generating said alternating magnetic field and for detecting said modulation or addition to said field comprise a common coil structure.

3. A lock according to claim 1 wherein said coil means are wound around said frusto-toroidal part at a position in proximity to one of said ends thereof.

4. A lock according to claim 1 wherein said core structure is made from ferrite material.

5. A lock according to claim 1 wherein the major portion of said barrel is made from metal and said two further parts of the core structure are mounted therein through inserts of electrically non-conductive material.

6. A lock according to claim 1 in combination with a key having a bit for insertion into the aforesaid keyway and which bears an inductive transmission element for modulating or adding to the aforesaid magnetic field, the transmission element being positioned in said bit so as to pass into the aforesaid region of the keyway when the bit is so inserted.

7. A combination according to claim 6 wherein the spacing of said transmission element along the key bit is related to the spacing of said region along the keyway such that the transmission element passes through said region to enable reception by the reading means of the code from the key before the bit is fully inserted in the keyway.

8. A combination according to claim 6 wherein said transmission element of the key is located adjacent to one or two further parts of said toroidal core structure which are mounted in the key bit to one or both sides of said transmission element and juxtaposed respectively to one or both of said parts of said core structure mounted in the barrel, when the key bit is inserted in the keyway.

9. A combination according to claim 6 wherein said transmission element of the key comprises a coil wound about an axis transverse to the longitudinal axis of the key bit and oriented perpendicularly to the direction of magnetic flux passage across said region of the keyway when the key bit is inserted in the keyway.

10. A combination according to claim 9 wherein the key bit is of a flat cross-section and said transmission element is a planar element which is mounted therein in proximity to the tip of the key bit and parallel to a longer cross-sectional dimension thereof.

11. A combination according to claim 10 wherein the major part of the key bit is made of metal but the metal structure of the bit surrounding said transmission element is interrupted at least at one location to prevent the same acting as a shorted turn.

12. A combination according to claim 6 wherein said transmission element of the key is formed as an integral element of an integrated circuit which provides also circuit elements for the storage and retrieval of the said code.

13. A key having a bit configured to fit within the keyway of claim 6, the key comprising code storage means and said bit bearing said inductive transmission element associated with said code storage means for modulating or adding to the aforesaid magnetic field generated in a region of the keyway, in accordance with the code stored in said code storage means, said transmission element being positioned in said bit so as to pass into said region when the bit is inserted into the keyway.

14. A key according the claim 13 wherein the spacing of said transmission element along said bit is related to the spacing of said region along the keyway such that the transmission element passes through said region to enable reception of said code from the key by the reading means of the lock before the bit is fully inserted in the keyway.

15. A key according to claim 13 wherein one or two further parts of said toroidal core structure are mounted in said bit to one or both sides of said transmission element and are juxtaposed respectively to one or both of said parts of said core structure mounted in the barrel of the lock when the bit is inserted in the keyway.

16. A key according to claim 13 wherein said transmission element comprises a coil wound about an axis transverse to the longitudinal axis of the bit and is oriented perpendicularly to the direction of magnetic flux passage across said region of the keyway when the bit is inserted in the keyway.

17. A key according to claim 16 wherein the bit is of a flat corss-section and said transmission element is a planar element which is mounted therein in proximity to the tip of the bit and parallel to a longer cross-sectional dimension thereof.

18. A key according to claim 17 wherein a major part of the bit is made of metal but the metal structure of the bit surrounding said transmission element is interrupted at least at one location to prevent the same acting as a shorted turn.

19. A key according to claim 13 wherein said transmission element is formed as an integral element of an integrated circuit which provides also said code storage means and circuit elements for the retrieval of said code.

* * * * *